United States Patent [19]

Parr

[11] 4,168,689

[45] Sep. 25, 1979

[54] FUEL INJECTOR INTERNAL PASSAGES AND FILTER

[75] Inventor: Richard D. Parr, Washington, Ill.

[73] Assignee: Caterpillar Tractor Co., Peoria, Ill.

[21] Appl. No.: 804,641

[22] Filed: Jun. 8, 1977

[51] Int. Cl.[2] ..... F02M 39/00; F02F 7/00

[52] U.S. Cl. ..... 123/139 AT; 123/139 AK; 123/139 AW; 123/32 R; 123/195 C

[58] Field of Search ..... 123/139 AW, 139 AT, 123/139 AK, 195 C, 32 R, 193 CH

[56] References Cited

U.S. PATENT DOCUMENTS

| | | | |
|---|---|---|---|
| 1,982,023 | 7/1931 | Ritz | 123/139 AT |
| 2,062,644 | 12/1936 | Ensign | 123/139 AW |
| 2,916,028 | 12/1959 | Mansfield | 123/139 AT |
| 3,753,426 | 8/1973 | Lilley | 123/139 AK |
| 3,782,864 | 1/1974 | Perr | 123/139 AK |
| 3,845,748 | 11/1974 | Eisenberg | 123/32 R |
| 4,036,195 | 7/1977 | Bailey | 123/139 AK |
| 4,046,122 | 9/1977 | Nakagawa et al. | 123/139 AW |

*Primary Examiner*—Charles J. Myhre
*Assistant Examiner*—P. S. Lall
*Attorney, Agent, or Firm*—Wegner, Stellman, McCord, Wiles & Wood

[57] ABSTRACT

A fuel supply system is provided, including a plurality of fuel injection pumps within the cylinder head on a cylinder block, a fuel manifold having a fuel supply portion and a fuel return portion external to the cylinder head and extending the length thereof, each pump having a fuel supply and outlet passage integrally formed in the cylinder head and communicating with an annular passageway about each fuel injector, each said fuel supply and outlet passage further communicating with said fuel manifold by means of a pair of exterior conduits extending from the manifold directly to opposite ends of said passage in the cylinder head, each said exterior conduit extending exteriorly of the valve covers to preclude contamination of engine lubricant with fuel that may leak from the connections between exterior conduits and the passages in the cylinder head. Each pump includes a plurality of radially spaced inlets and outlets communicating with the annular passageway and a selected filter is positioned in each said inlet and outlet.

17 Claims, 9 Drawing Figures

FIG. 2
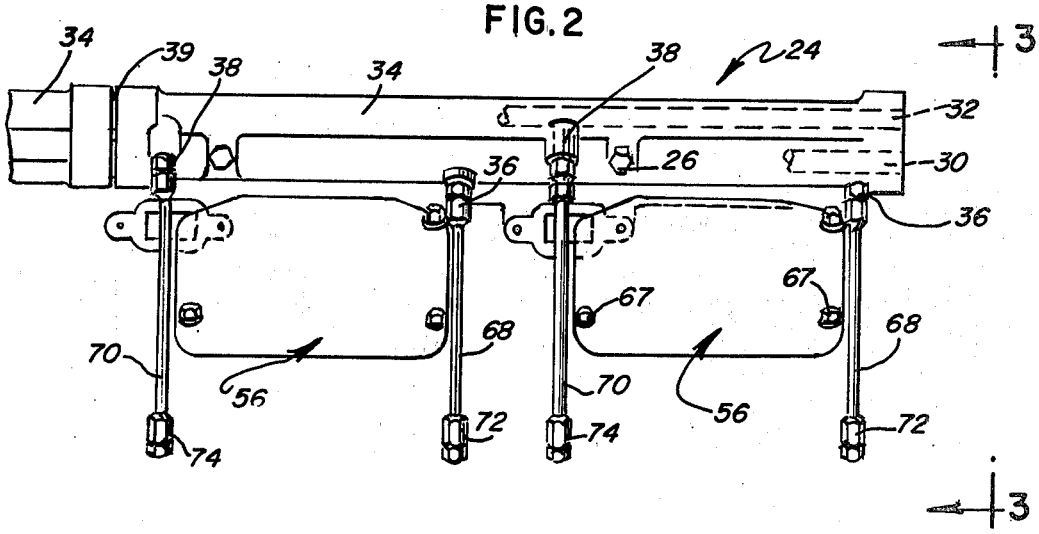
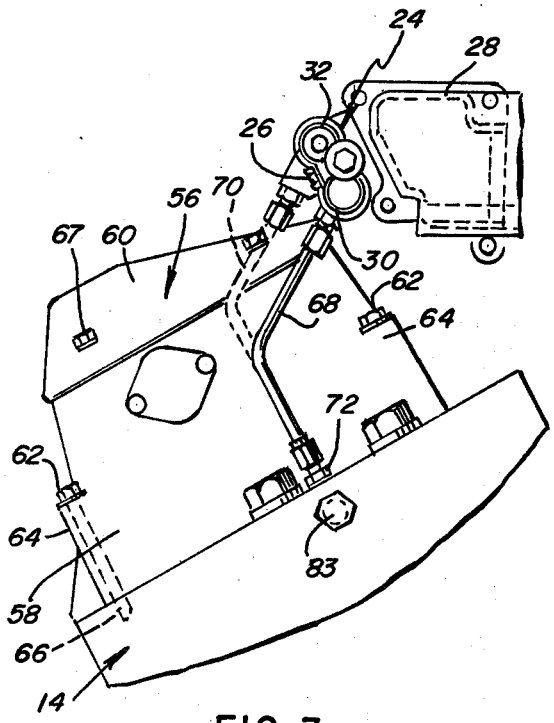
FIG. 3
FIG. 7
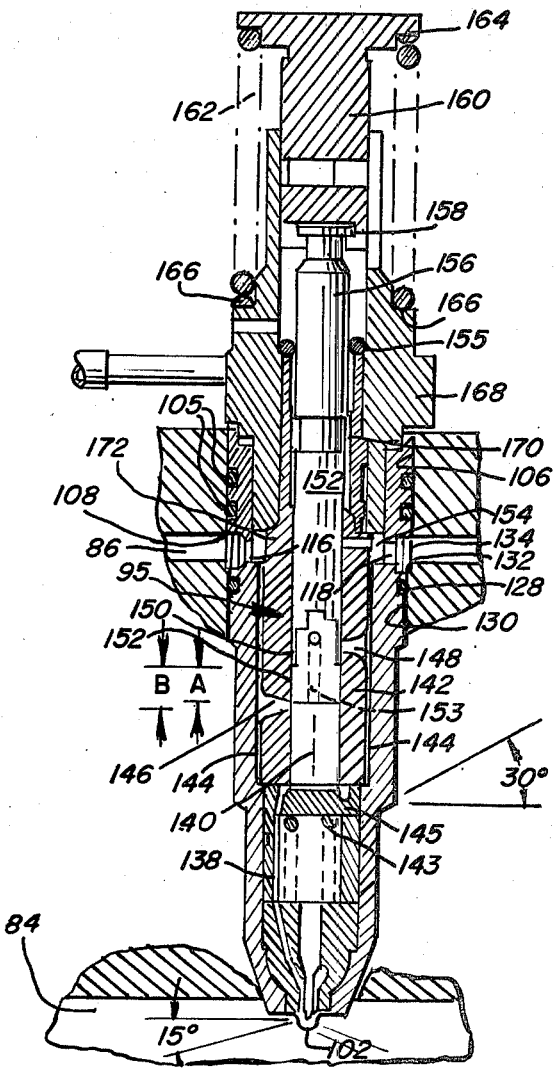

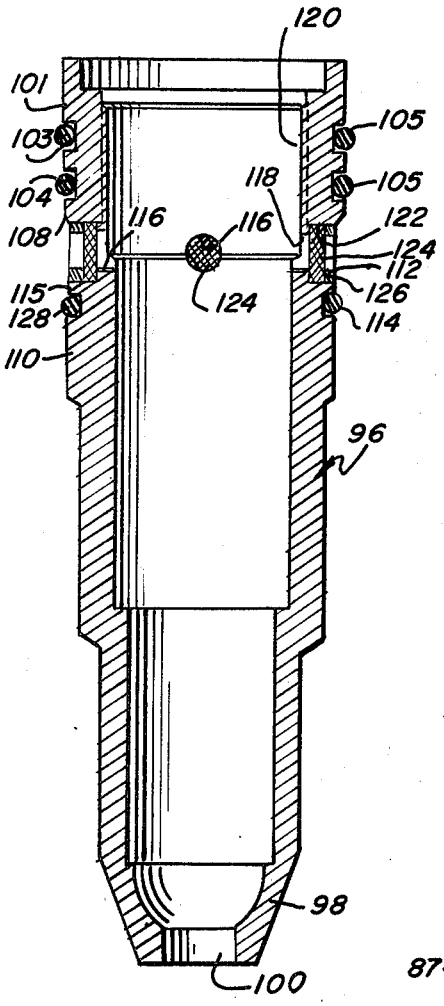
FIG. 6
FIG. 8
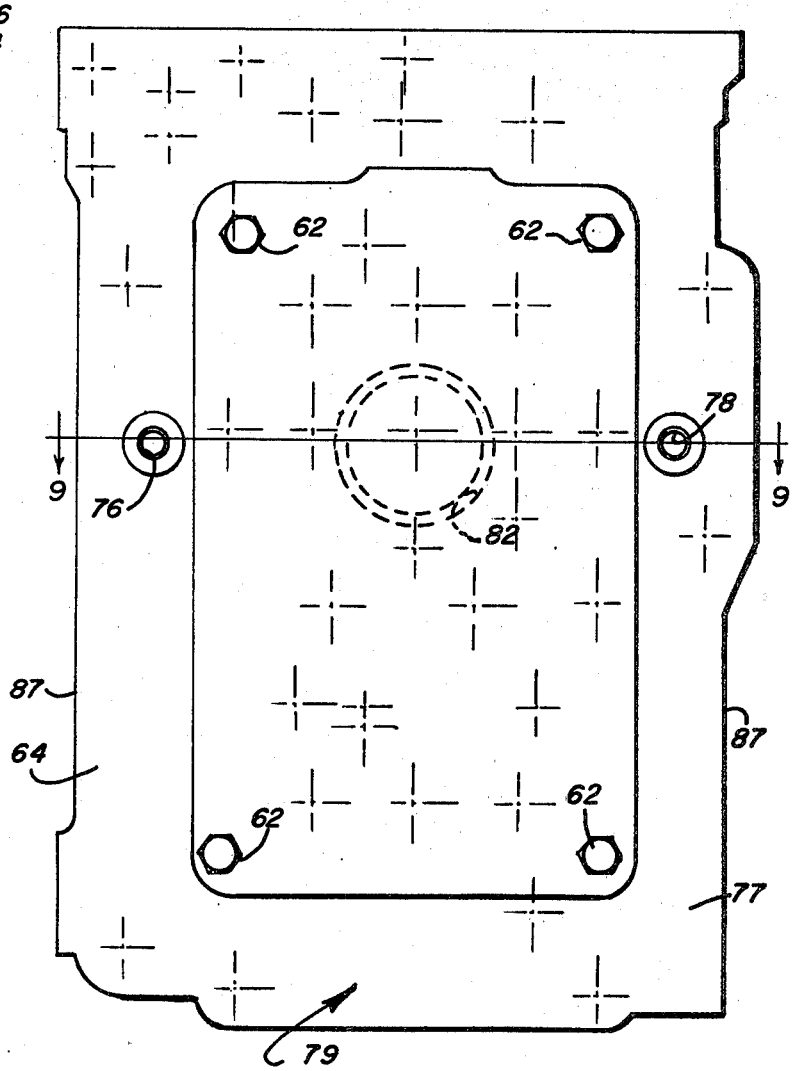
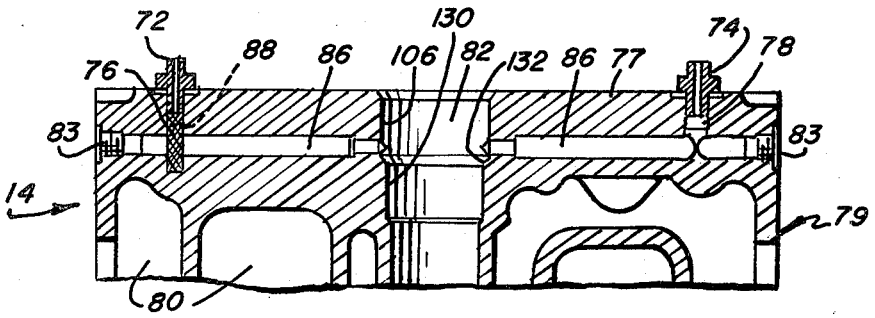
FIG. 9

FUEL INJECTOR INTERNAL PASSAGES AND FILTER

BACKGROUND OF THE INVENTION

1. Field of the Invention

This invention relates to fuel-injection systems and, more particularly, to an improved fuel manifold and supply system for supplying fuel directly to cylinder head passages exteriorly of the valve covers.

2. Description of the Prior Art

Previous fuel injection supply systems encountered problems from the need for an excessive number of fittings between a fuel source and each individual injection pump. The supply lines passed through the valve cover of the engine and into a fitting connected to each injection pump. Special connections and fittings were required to pass each supply line through the valve cover and to connect the supply line to the pump. Occasionally, the fittings in the valve cover or to the pump leaked, permitting fuel to mix with the engine lubricating oil which mixture would not provide adequate lubrication for the engine. The inadequate lubrication could cause overheating and engine damage or failure.

The necessity for the supply lines to run through and be connected to the unitary valve cover created assembly and service problems in that each time one line needed service, all of the lines had to be disconnected from the valve cover. Also, each time the valve rockers or the individual fuel injection pumps needed inspection or service, all of the supply line fittings had to be disconnected before the valve cover could be removed.

One fairly recent attempt to solve the problem entailed providing one continuous inlet conduit and one continuous outlet conduit through the engine block or cylinder head and into communication with the injection pump of each cylinder. This continuous conduit concept eliminated the fittings and possible dilution of the lubricant problem, but has the inherent defects of requiring a complicated boring operation in the engine block. Also, if the conduit becomes blocked, all cylinders downstream are left without fuel causing engine failure. The service problem to unplug the conduit is complicated and expensive, requiring substantially a complete tearing down of the engine to gain the needed access to the plugged conduit.

A second fairly recent attempt to solve the problem provides for a conduit through the side of the cylinder head directly into the injection pump with the inlet fuel being fed through an internal conduit and the return fuel passing exteriorly of the tube forming said internal conduit. This solution also has shortcomings in that the fuel must enter and leave the pump in the same area and the inlet and outlet conduits are easily blocked.

SUMMARY OF THE INVENTION

The present invention is directed to overcoming one or more of the problems as set forth above.

According to the present invention, an internal fuel supply and outlet passage is provided within a cylinder head leading to and from an annular passageway surrounding each fuel injection pump. Each supply and outlet passage communicates with the top surface of the cylinder head and, via exterior conduits, communicates with a manifold which has a fuel supply portion and a fuel return portion. An individual valve cover is provided for each injection pump and an associated set of rockers. The external conduits are connected to the passages by fittings directly on the top surface of the cylinder head at a location exterior of adjacent individual valve covers so that fuel leaking from said fittings will not come in contact with and contaminate the engine lubricating oil.

Providing the cylinder head with individual internal passages to each injection pump reduces the required number of bulkhead fittings, thereby simplifying fuel supply system hookup and service, as well as preventing unwanted leakage and contamination.

Each annular fuel supply passageway associated with each injection pump in the cylinder head communicates with each interior fuel supply and outlet passage and with radially spaced openings in the housing of each injection pump. Fuel filters are disposed in each opening in the housing of each pump to prevent contaminants from reaching the interior of the pump. It is also contemplated that fuel filtering devices can be installed in the passages upstream of the injectors in the cylinder head.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 2 is a partial elevational view of the fuel manifold with a fuel supply portion and a fuel return portion and exterior fuel inlet and outlet conduits connected to the cylinder head of the engine of FIG. 1, the view of FIG. 2 being taken generally at right angles to the view of FIG. 1;

FIG. 3 is a further elevational view of the fuel manifold with a fuel supply portion and a fuel return portion and exterior fuel inlet and outlet conduits of FIG. 2, taken generally along line 3—3 of FIG. 2;

FIG. 6 is a sectional elevational view of a fuel injection pump housing to be disposed within the cylinder head of the engine of FIG. 1;

FIG. 7 is a sectional elevational view of a fuel injection pump contained within the housing of FIG. 6;

FIG. 8 is a plan view of a portion of a cylinder head showing the inlet and outlet ports for one cylinder and showing one individual valve cover in place; and FIG. 9 is a cross-sectional view taken along the line 9—9 of FIG. 8 showing internal fuel inlet and outlet conduits and a bore or opening for the injection pump housing.

DESCRIPTION OF THE PREFERRED EMBODIMENT

Figure 1:
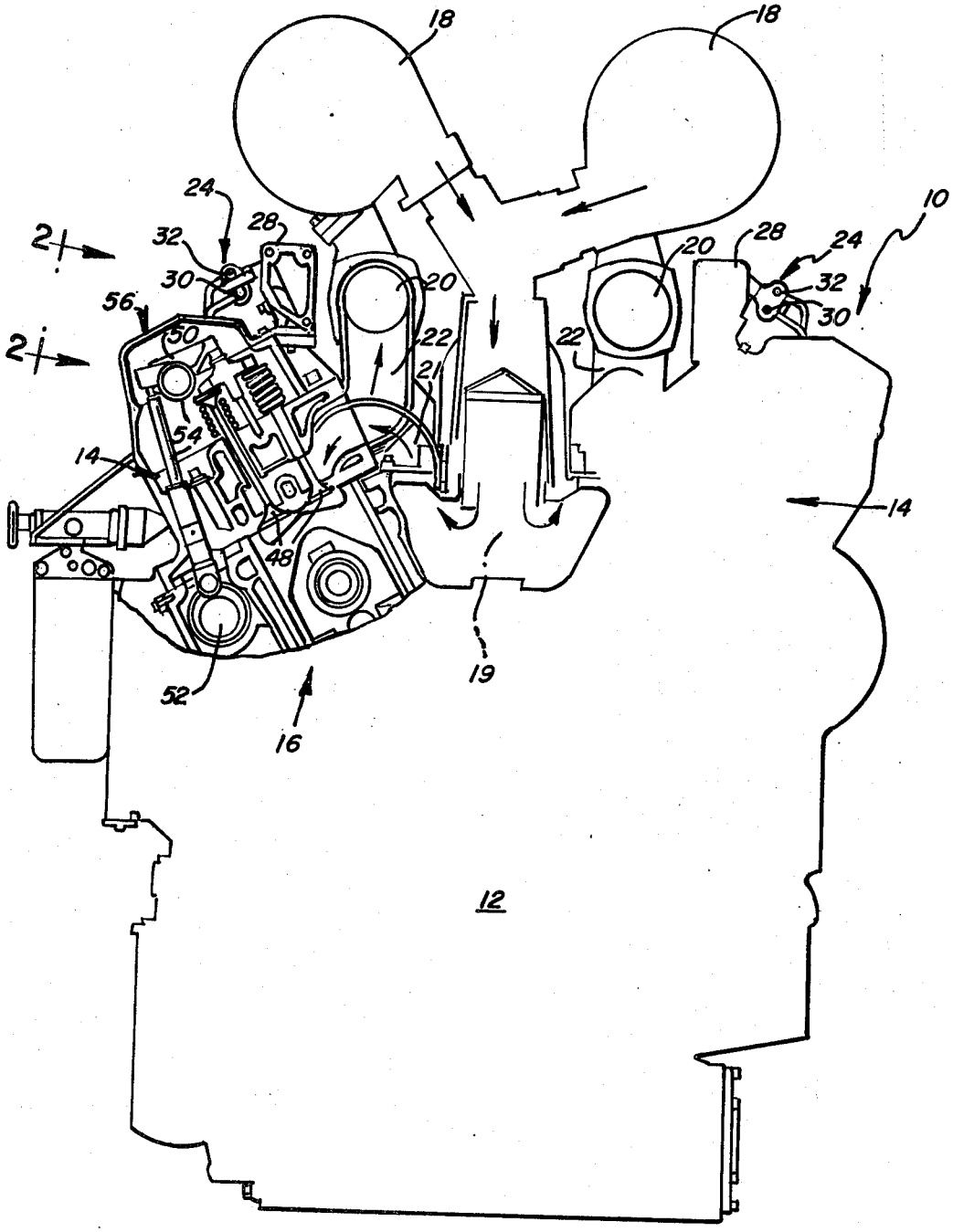
FIG. 1 is an elevational view of a vehicle engine embodying the fuel supply system of the invention, with some parts shown in section and some parts shown in phantom outline.

FIG. 1 shows, partially in section, an internal combustion engine 10, such as a diesel engine, embodying the fuel supply system of the present invention. The engine includes a cylinder block 12 with a pair of cylinder heads 14 extending over a plurality of cylinders 16 with said heads 14 disposed angularly with respect to each other in a V-relation. Combustion of fuel occurs in the cylinders 16 to provide motive force to drive a crank shaft (not shown) in the conventional manner. Dual air filters and/or turbochargers 18 communicate with air intakes 19 for delivery of air, via suitable passageway 21, to each of the cylinders 16 for mixture with fuel in a controlled manner. Exhaust from each cylinder 16 exits through a passageway 22 to the exhaust manifold 20.

In the practice of the present invention, a fuel manifold 24 is provided on each side of the engine and extends substantially the full length of the battery of cylinders located on said side of the engine. In the present example, six cylinders 16 are formed in the cylinder block 12 on each side of the engine with each manifold 24 being mounted above the appropriate cylinder head 14 and being bolted at 26, or otherwise secured, to a water manifold 28. The fuel manifold 24 is divided into a fuel inlet or supply portion 30 and a fuel return portion 32, and, as shown in FIG. 2, said fuel manifold 24 is sectionalized with each section 34 having two pairs of openings 36,38, one pair 36 being tapped into the fuel inlet or supply portion 30 and the other pair 38 being tapped into the fuel return portion 32. The sections 34 are interconnected together as by appropriate connections 39, such as a male-female connection, sleeves, or the like.

Figure 4:
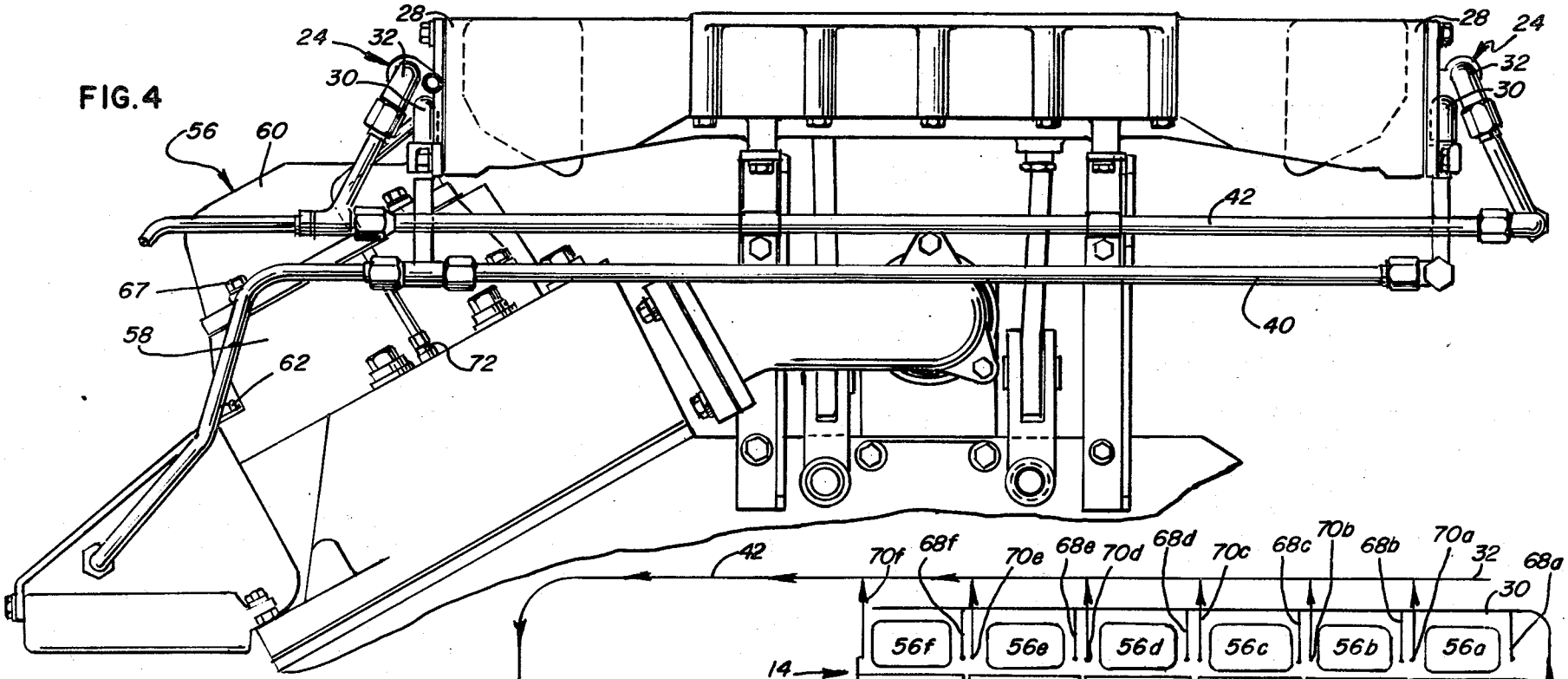
FIG. 4 is a partial front elevational view of the engine showing the interconnection of the fuel manifold on one side of the engine to the fuel manifold on the other side of the engine.

The two fuel manifolds 24, on the opposite sides of the engine, are interconnected with each other, as shown in FIG. 4, wherein tubing 40 connects the fuel supply portion 30 on the right-hand side of the engine with the fuel supply portion 30 on the left-hand side of the engine, and the tubing 42 connects the fuel return portion 32 on the right with the fuel return portion 32 on the left. It will be noted in FIG. 4 that although tube 42 is shown broken off, it is to be understood that tube 42 is connected back to the supply tank 44, shown in the schematic diagram of FIG. 5. The fuel supply tube or line 40 is shown connected to the fuel filter 46 which in turn is connected to a pump, as will be described hereinafter.

Each cylinder 16 in the block 12 and head 14 has the usual valves 48 which are operated by a rocker 50 actuated by a cam 52 and follower 54. Each cylinder 16 has an individual valve cover 56 for covering the rocker 50, valve actuators and related mechanisms of said cylinder. As shown in FIGS. 1–4, each valve cover 56 is comprised of a hollow open-ended body 58 and a cap 60 with the body 58 having four bolts 62 passing through drilled offsets 64 and being threaded into tapped openings 66 in the top of the cylinder head 14. The cap 60 is bolted to the body 58 by bolts 67 passing through the cap 60 and being threaded into openings in the body 58. Adjacent valve covers 56 are spaced apart a short distance such that, as shown in FIGS. 2 and 3, two conduits, one fuel inlet conduit 68 and one fuel outlet conduit 70, can pass therebetween with sufficient clearance for appropriate fittings 72,74 to connect the conduits 68,70, respectively, to tapped stub passages 76,78 in the top surface 77 of the cylinder head 14. As shown in FIGS. 8 and 9, the cylinder head 14 is divided into separate portions 79 with one cylinder 16 in each portion. Adjacent portions 79 are assembled together to form the head 14 which has the usual cores and openings 80 for the circulation of coolant and the like. A stepped bore or opening 82 is formed transversely from the top surface 77 of the head 14, substantially in the middle of each portion 79 of the cylinder head 14, and extends through said head into communication with a combustion chamber 84, FIG. 7, defined by the lower surface of the cylinder head 14 and the cylinder openings in the cylinder block 12.

A passage 86 is formed inward from each side 87 of each portion 79 of the cylinder head 14 and is reduced in diameter near said bore or opening 82. Plugs 83 are seated in the outer ends of the passages 86. The spaced apart stub passages 76,78 are formed transversely through the top surface 77 of the cylinder head 14 and intersect each said passage 86. The stub passages 76,78 are located relatively close to the side edges 87 of each portion 79 of the cylinder head 14 so that the lower edge of the body 58 of the valve cover 56 seats on the top surface 77 of the head 14 between the openings formed by the stub passages 76,78 and the bore 82. A fitting 72 is threaded into stub passage 76 on the inlet end (left-hand side of FIG. 9) with a fitting 74 being threaded into stub passage 78 on the outlet end (right-hand side of FIG. 9). As described above, one inlet fuel conduit 68 is connected through fitting 72, stub passage 76 to the inlet end of passage 86, and one outlet fuel conduit 70 is connected through fitting 74, stub passage 78 to the outlet end of passage 86. Fuel filtering devices, such as screens 88 shown in dotted lines in FIG. 9, may be positioned in the stub passage 76, in the passage 86, or at the intersection of passages 76 and 86 to filter fuel as it enters the head 14. The filter 88 can be inserted and removed through the top surface 77.

Figure 5:
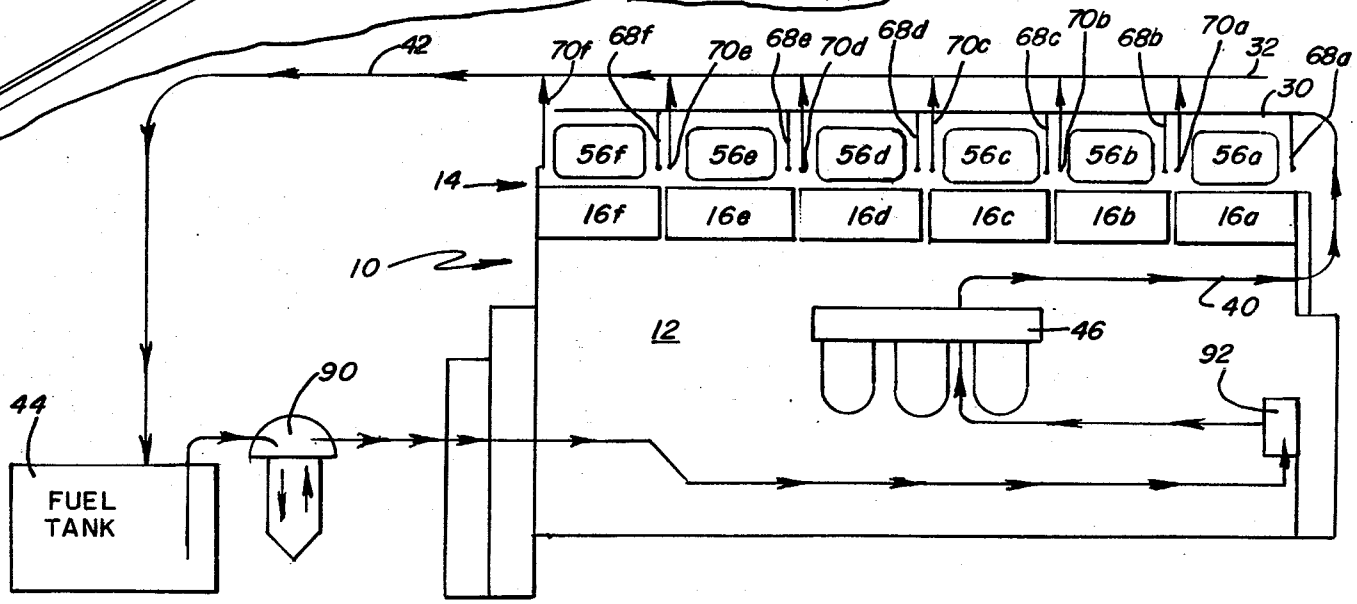
FIG. 5 is a schematic diagram showing the flow of fuel in the fuel supply system of the present invention.

The path followed by fuel, as it is fed to the various cylinders, is best illustrated by reference to the schematic showing of FIG. 5 wherein fuel is shown stored in the tank 44 and is drawn from the tank 44 and passes through preliminary filter 90 to the suction side of the fuel transfer pump 92. From the transfer pump 92, the fuel flows through the fuel filters 46 and tubing 40 to the inlet or supply portion 30 of the fuel manifold 24. The fuel in inlet portion 30 of the manifold 24 is distributed through the respective inlet conduits 68 to the inlet ends of passages 86 in the cylinder head 14. The fuel that is not used by the injection pumps in each cylinder 16 bypasses the cylinder and exits the outlet ends of passages 86 through outlet conduit 70 to the fuel return portion 32 of the manifold 24. The fuel flows from return portion 32 through tubing 42 back to the tank 44. FIG. 5 illustrates six cylinders, designated 16*a*, 16*b*, 16*c*, 16*d*, 16*e*, 16*f*, with valve covers 56*a*, 56*b*, 56*c*, 56*d*, 56*e*, 56*f*, inlet conduits 68*a*, 68*b*, 68*c*, 68*d*, 68*e*, 68*f*, and outlet conduits 70*a*, 70*b*, 70*c*, 70*d*, 70*e*, 70*f*. The illustrated configuration is one bank of a V-12 type engine, with the other bank likewise numbered and connected to the illustrated bank by means of the piping shown in FIG. 4. It is to be understood that the arrangement proposed is usable on any type of engine, such as a six-cylinder, an eight-cylinder, or the like engine.

Referring now to FIG. 6, a fuel injection pump housing 96 is illustrated and is generally cylindrical in shape and machined to correspond to the shape of the bore or opening 82 in the cylinder head 14. The interior of the housing 96 is machined to correspond to the shape of an injection pump barrel assembly 95, described more in detail below.

The housing 96 includes a bottommost chamfered end 98 which includes an opening 100. When the housing 96 is positioned within the bore 82 in the cylinder head 14, a portion of the bottommost end 98 will align with the bottom surface of the cylinder head 14 and face into the combustion chamber 84 above the cylinder, allowing the injection pump tip 102 of the injection pump assembly 95 to inject fuel directly into the combustion chamber 84.

The exterior surface of the enlarged diameter end portion 101 of the housing 96, spaced from the chamfered end 98, has formed therein a pair of concentric grooves 103, 104 in which sealing rings 105 seat, as shown in FIG. 7, and bear against the wall of the first step 106 of the opening or bore 82 in the head 14. The end portion 101 has a tapered shoulder 108 joining said portion 101 with a reduced diameter portion 110 in which is formed two concentric grooves 112 and 114 separated by a flange 115. The groove 112 has a plurality of ports 116, 118 extending radially into the open center portion 120 of said housing 96. Circular concentric seats 122 are formed about each port 116,118, in each one of which is seated a filter 124 which is held in place by a ring 126. A sealing ring 128 is seated in groove 114 so that with the housing 96 nested in the opening or bore 82 in the head 14, the ring 128 contacts a second step 130 of said opening or bore 82 with a shoulder 132 between the first step 106 and the second step 130 aligning with the flange 115 between the grooves 112 and 114.

As shown in FIG. 7, the passage 86 in the head intersects with the first step 106 of opening or bore 82 just above the shoulder 132. A bypass passageway 134 is provided around the housing 96 in alignment with both the ports 116,118 in the housing 96 and with both ends of the passage 86 in the head 14. The bypass passageway 134 is formed by the shoulder 108 on the housing 96 and by the shoulder 132 in the opening or bore 82 in the head, with the part of the first step 106 forming the outer wall, and the part of the reduced diameter portion 110 of the housing 96 forming the inner wall. From the just described structure, it will be noted that fuel from the inlet end of passage 86 enters through the head 14 into the passageway 134 with some of said fuel flowing through ports 116 into the injection pump assembly 95 and with the remaining fuel flowing around said passageway 134 and into the outlet end of the passage 86.

Referring still to FIG. 7, the fuel injection pump assembly 95 is shown positioned within the associated housing 96. The injection pump 95 includes the nozzle 102 at its lowermost end. The nozzle 102 communicates, via a fuel conduit 138, with a chamber 140 in an annular plunger housing 142. A spring 143 actuates valve 145 to seal off communication between said chamber 140 and said conduit 138. An annular space 144 surrounds the plunger housing 142 and communicates through a port 146 with the chamber 140 and by a port 148 with an annular recess 150 in the plunger 152. The annular recess 150 in the plunger 152 communicates through porting 153 into the chamber 140. The annular space 144 is in continuous communication with an annular chamber 154 which in turn is in continuous communication with the radial ports 116,118 in the housing 96, so that fuel from passage 86 through ports 116 keeps the annular chamber 154 and annular space 144 continuously full.

The upper portion of the interior of the injection pump assembly 95 has a gear retainer 155 through which an end portion 156 of the plunger 152 extends. The uppermost end of the plunger 152 includes a head 158 which is captured by an actuator 160. The upper horizontal surface of the actuator 160 is contacted by the hammer of the pivoted rocker 50. A helical spring 162 is interposed between the head 164 of the actuator 160 and an abutment surface 166 of an annular collar 168. The spring 162 urges the actuator 160 to its uppermost position when force from the rocker 50 is removed.

In operation, fuel flows from the fuel supply portion 30 of the manifold 24 and conduit 68 into the individual passage 86 and passageway 134 for each injection pump with some of the fuel flowing through the filter screens 124 and openings 116 into annular chamber 154 and annular space 144 with the remaining fuel bypassing the injection pump and dumping or returning to the fuel return portion 32 of the manifold. It should be noted that the inlet and return of the fuel to the cylinder head is located physically higher than in previous systems. When the plunger 152 is in its upper position, shown in FIG. 7, fuel flows from space 144 not only through the port 146 into the chamber 140, but also through port 148, annular recess 150 and porting 153 into said chamber 140.

When the rocker 50 strikes the actuator 160, the plunger 152 travels downwardly a distance "A" whereby the port 148 is closed blocking flow of fuel from space 144 through recess 150 and porting 153. As the plunger 152 continues to travel downwardly through a distance "B", the port 146 is closed blocking flow of fuel into the chamber 140. The plunger 152 now forces the fuel to depress the spring 143, open the valve 145 and force the fuel through conduit 138 and nozzle 102 into the combustion chamber 84.

The structure of the injection pump assembly 95, described above, has the passageway 134, the annular chamber 154, and the annular space 144 flooded with fuel at all times. Excess fuel flowing to the annular space 144 in the pump assembly 95 from the inlet end of passage 86 is returned to the outlet end of passage 86 by pressure of the fuel and by pressure generated by the downward travel of the plunger 152.

From the above, it can be seen that I have provided an improved interior fuel distribution arrangement whereby the fuel is transmitted by manifolds to a location near the injectors and is then conveyed by conduits directly to each individual interior fuel passage formed in the cylinder head. Each passage communicates with a bypass passageway around the injection pump housing to bypass excess fuel back to the manifold for return to the fuel supply, all without exposing the fuel lines to possible leaking into the lubricating oil system whereby the lubricating oil would be diluted and contaminated by the fuel oil. Filter screens are provided in the passages into the injection pump housing, which screens have openings of a size to prevent any particles passing therethrough that are large enough to block or interfere with the operation of the injection pump. The additional filter at the point of entry of fuel into the injector, filters out, at the last possible location, any particles that are likely to interfere with the injection pump. The covers 56, being individually mounted for each cylinder, can be removed individually to service the rocker 50 and associated parts without disturbing the fuel line connections. With the cover 56 removed, the injection pump 95 and injection pump housing 96 can be removed and the filter screens 124 can be cleaned or replaced all without disturbing the connection of the fuel lines to the cylinder head. The screens 88 may be used in stub passage 76 to further filter the fuel entering the injection pump 95. The screens 88 may be used with filter screens 124 or may be used separately.

The embodiments of the invention in which an exclusive property or privilege is claimed are defined as follows:

1. In an internal combustion engine having a cylinder block, a cylinder head mounted on said block, a plurality of cylinders in said block, a plurality of fuel injection pumps mounted in openings in said cylinder head for supplying fuel to combustion chambers associated with said cylinders, a fuel supply tank, a fuel transfer pump connected to said tank, a fuel manifold carried by said engine and having a fuel supply portion and a fuel return portion, said transfer pump being connected to said fuel supply portion and said tank being connected to said fuel return portion, a fuel passage in the cylinder head for each injection pump, each passage has an inlet end on one side of its respective injection pump and an outlet end on the other side of said injection pump, a conduit connecting said fuel supply portion to the inlet end of the passage for each injection pump and a second conduit connecting said fuel return portion to the outlet end of the passage for each injection pump whereby fuel is delivered from the tank through the transfer pump, the manifold and one conduit to the inlet end of the passage and to the injection pump with surplus fuel delivered back to the tank through the outlet end of the passage, the second conduit and the fuel return portion of the manifold.

2. In the internal combustion engine of claim 1 wherein a passageway extends around each said injection pump and is in communication with the inlet end and outlet end of the passage for each said injection pump whereby surplus fuel flooded to each injection pump is bypassed to the outlet end of said passage.

3. In the internal combustion engine of claim 2 wherein each injection pump has an individual cover fastened to said cylinder head, each cover is spaced from the adjacent covers a distance sufficient to permit the location of the inlet end of the passage for one injection pump and the outlet end of the passage for the adjacent injection pump therebetween.

4. In the internal combustion engine of claim 1 wherein each injection pump has a housing which seats in one of said openings formed in said cylinder head, said housing having at least two openings communicating with the passage in said cylinder head whereby fuel may pass into or out of the injection pump seated in said housing.

5. In the internal combustion engine of claim 4 wherein a filter is seated in each of said openings in said housing to filter out particles of a predetermined size.

6. In the internal combustion engine of claim 5 wherein a second filter is seated in the inlet end of each of said passages in said cylinder head.

7. In the internal combustion engine of claim 5 wherein said housing has a passageway formed around its outer periphery in alignment with said openings in said housing, said passageway being defined by one shoulder on said housing axially spaced from a second shoulder in said opening in said cylinder head, and a sealing ring seated above said one shoulder on the housing and a second sealing ring seated below said second shoulder on the housing with both said rings bearing between said housing and the wall of said opening in the cylinder head.

8. In the internal combustion engine of claim 1 wherein a filter is seated in the inlet end of each of said passages in said cylinder head.

9. In an internal combustion engine having a cylinder block, a cylinder head mounted on said block, a plurality of cylinders in said block, a plurality of fuel injection pumps mounted in openings in said cylinder head for supplying fuel to combustion chambers associated with said cylinders, a plurality of passages formed in said head with each injection pump having one of said passages associated therewith, each passage having an inlet end on one side of said injection pump and an outlet end on the other side of said injection pump, a fuel manifold carried by said engine and having a fuel supply portion and a fuel return portion, an individual conduit connecting said fuel supply portion to the inlet end of the passage for each injection pump and another individual conduit connecting said fuel return portion to the outlet end of the passage for each injection pump, whereby fuel in the fuel supply portion of the manifold is delivered to each injection pump and surplus fuel in each injection pump is returned to the fuel return portion of the manifold.

10. In the internal combustion engine of claim 9 wherein a passageway formed around each said injection pump and in communication with the inlet end and outlet end of the passage for each injection pump whereby surplus fuel flooded to the injection pump is bypassed to the outlet end of said passage.

11. In the internal combustion engine of claim 9 wherein each injection pump has an individual cover fastened to said cylinder head, with adjacent covers spaced from each other a distance sufficient to permit the location of the inlet end of the passage for one injection pump and the outlet end of the passage for the adjacent injection pump therebetween.

12. In the internal combustion engine of claim 9 wherein an injection pump housing seats in each of said openings in said cylinder head, said housing having at least two openings communicating with the passage in said cylinder head whereby fuel may pass into or out of the injection pump seated in said housing.

13. In the internal combustion engine of claim 12 wherein a filter is seated in each of said openings in said housing to filter out particles of a predetermined size.

14. In the internal combustion engine of claim 13 wherein a second filter is seated in the inlet end of each passage.

15. In the internal combustion engine of claim 13 wherein said housing has a passageway formed around its outer periphery in alignment with said openings, in said housing said passageway being defined by a first shoulder on said housing axially spaced from a second shoulder in the wall of said opening in said cylinder head, and a sealing ring seated above said first shoulder on the housing and a second sealing ring seated below said second shoulder on the housing with both said rings bearing between said housing and the wall of said opening in the cylinder head.

16. In the internal combustion engine of claim 9 wherein said fuel manifold is mounted on said engine above the top surface of said cylinder head.

17. In the internal combustion engine of claim 9 wherein a filter is mounted in the inlet end of each said passage in the cylinder head.

* * * * *